United States Patent [19]

Ohkata

[11] Patent Number: 4,523,605

[45] Date of Patent: Jun. 18, 1985

[54] FREEZE PREVENTING VALVE

[75] Inventor: Ichizo Ohkata, Yokohama, Japan

[73] Assignee: Kato Hatsujo Kaisha Ltd., Yokohama, Japan

[21] Appl. No.: 603,769

[22] Filed: Apr. 25, 1984

[30] Foreign Application Priority Data

Dec. 31, 1983 [JP] Japan ..... 58-251423

[51] Int. Cl.[3] ..... E03B 7/12

[52] U.S. Cl. ..... 137/62; 60/527; 116/218; 137/468; 236/101 D; 237/80; 251/11

[58] Field of Search ..... 60/527; 116/216, 218; 137/59, 60, 61, 62, 79, 468; 236/66, 93 R, 101 D, 101 R; 237/80; 251/11; 374/197

[56] References Cited

U.S. PATENT DQCUMENTS

| | | | |
|---|---|---|---|
| 398,719 | 2/1889 | Gold | 236/58 |
| 1,392,617 | 10/1921 | Augustin | 137/505.43 |
| 3,403,238 | 9/1968 | Buehler et al. | 251/11 |
| 3,428,251 | 2/1969 | Gross et al. | 236/92 R |
| 4,066,090 | 1/1978 | Nakajima et al. | 237/80 |
| 4,325,217 | 4/1982 | Golestaneh | 116/218 |
| 4,344,450 | 8/1982 | Walters | 237/80 |

*Primary Examiner*—George L. Walton

*Attorney, Agent, or Firm*—Schwartz, Jeffery, Schwaab, Mack, Blumenthal & Evans

[57] ABSTRACT

A freeze preventing valve which comprises a valve cage body longitudinally provided with a cylindrical guide at the upper part thereof in a valve housing connected to a steam feed pipe, a valve element having a shaft disposed through the guide of the valve body to be able to open an exhaust port opened at the lower end of the housing and to be elevationally guided in the guide of the housing, a spring of shape memory alloy interposed between the lower surface of the valve body and the valve element for urging the valve element to close the valve element, a bias spring mounted between the upper surface of the valve body and the shaft protruding from the guide of the valve element upwardly for urging the valve element to open the valve element. Thus, the valve element of the freeze preventing valve is effectively supported and guided in the housing via the guide of the valve body. Since the both springs are effectively mounted through the valve body, the exhaust port can be automatically opened and closed with the spring of shape memory alloy and the bias spring instead of the conventional bellows.

4 Claims, 3 Drawing Figures

FREEZE PREVENTING VALVE

BACKGROUND OF THE INVENTION

This invention relates to a freeze preventing valve which can prevent itself from freezing even if the valve is used in a cold climate.

A room heater for a Diesel locomotive which travels during cold weather, for example, adopts in general a steam heater in view of structural and economical points. In this structure, valves for exhausting water from condensed steam are mounted at predetermined intervals at suitable positions along a steam feed pipe. A valve of this type is heretofore constructed, as shown in FIG. 1, to have a valve housing 2 connected to a steam feed pipe 1, an exhaust port 3 formed at the lower part of the housing 2, a valve element 4 disposed in the exhaust port 3 for opening or closing the exhaust port 3, a guide rod 5 for elevationally movably supporting the shaft 4*a* of the valve element 4, a valve body 6 for holding the rod 5 at the top thereof, and stainless bellows 7 disposed between the collar 5*a* of the rod 5 and the valve element 4. When the interior of the housing 2 is maintained by the stream at a high temperature, gas in the bellows 7 is heated and expanded to cause the bellows 7 to be elongated as shown in FIG. 1, thereby moving downwardly the valve element 4 to automatically close the exhaust port 3. Conversely when the steam is partly cooled to produce condensed water, which then flows into the housing 2 to thereby cool the bellows 7 through the pipe 1, the bellows 7 are contracted to move upwardly the valve element 4, with the result that the valve element 7 automatically opens the exhaust port 3. In this manner, the condensed water is naturally exhausted externally from the exhaust port 3 through a plurality of holes 6*a* perforated at the wall of the valve body 6.

Since the bellows 7 for automatically elevationally moving the valve element 4 upwardly or downwardly due to the temperature difference is, however, constructed to fill and seal the gas therein to be elongated as described above, the bellows 7 are affected by the influence of the fatigue of repeated elongations and contractions for a long period of time to become finely cracked, causing a gas leakage or improper opening or closing of the valve. Thus, the condensed water is concentrated in the valve housing in winter, the valve itself is thus frozen, and the valve housing is then damaged. Therefore, in order to remedy against the freeze of the valve with the condensed water, a preliminary valve 8 is opened to discharge the condensed water, or the valve body is formed in a lateral configuration. However, sufficient effect to overcome the above-described drawbacks cannot yet be achieved. To prevent the freeze of the valve of this type, it is necessary to check, maintain, and replace the bellows, and to provide a remedy of preventing the damage of the bellows themselves, i.e., the improvement of the durability in period and the reduction in the manufacturing cost.

SUMMARY OF THE INVENTION

Accordingly, an object of this invention is to provide a freeze preventing valve which can eliminate the aforementioned drawbacks and in which a spring of shape memory alloy is employed for elevationally moving a valve element upwardly or downwardly instead of bellows as a remedy of preventing the freeze of the valve.

According to the present invention, there is provided a freeze preventing valve in which a valve element is elevationally moved upwardly or downwardly by a structure which is a combination of a spring of shape memory alloy and a bias spring. More specifically, the valve element is elevationally moved upwardly or downwardly by a combination of a spring of shape memory alloy and a bias spring, a valve cage body in which a cylindrical guide is formed is secured into a valve housing, the shaft of the valve element is telescopically inserted into the cylindrical guide of the valve body to be upwardly projected to guide the valve element, a spring of shape memory alloy is mounted to urge the valve element so as to close the valve by elongating the valve element by means of sensing the high temperature at the lower surface of the valve element, and a bias spring is mounted to urge the valve element so as to open the valve by elongating the upper surface of the valve element. Thus, the above-described drawbacks are effectively eliminated.

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

Figure 1:
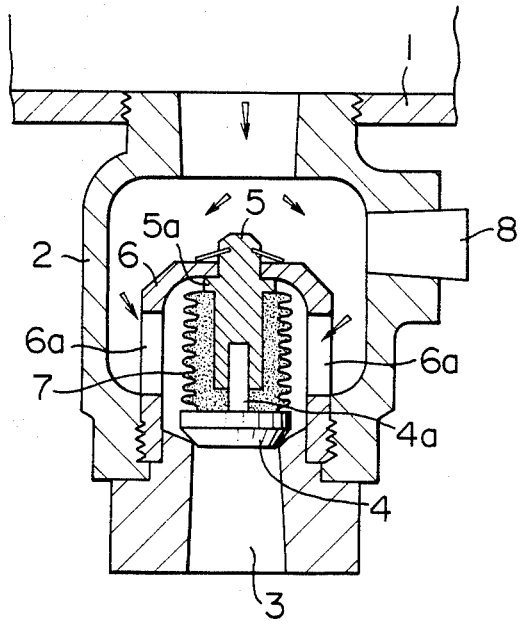
FIG. 1 is an elevational sectional view showing a conventional exhaust valve.
Figure 2:
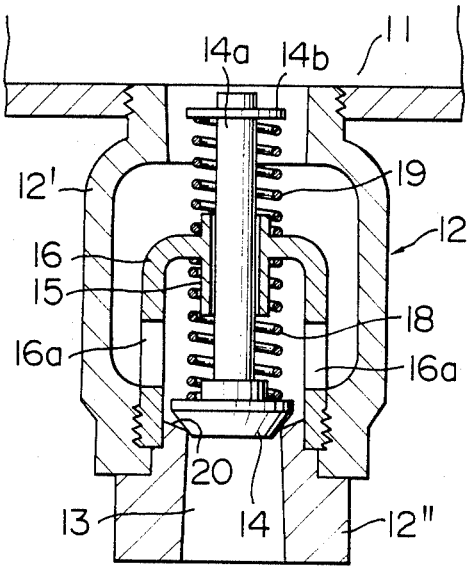
FIG. 2 is an elevational sectional view showing an embodiment of a freeze preventing valve according to the present invention in a closed state.
Figure 3:
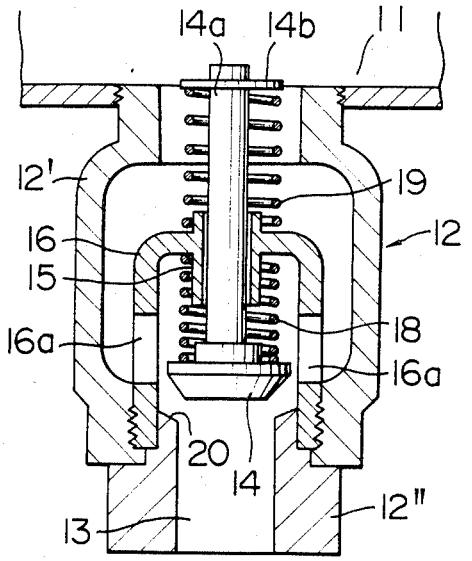
FIG. 3 is an elevational sectional view showing the valve of FIG. 2 in an open state.

An embodiment of a freeze preventing valve of the present invention will now be described in more detail with reference to the accompanying drawings. In FIGS. 2 and 3, a freeze preventing valve of the invention comprises a hollow valve housing 12 connected by means such as threading to a steam feed pipe 11, a valve cage body 16, in which a cylindrical guide 15 is longitudinally formed at the upper center thereof, installed by means such as threading in the housing 12, a valve element 14 having a longitudinally long shaft 14*a* inserted into the guide 15 of the valve body 16 so that the upper end thereof is upwardly protruded and the valve element 14 is elevationally movably supported and guided in the guide 15 and an upper end collar 14*b* mounted at the upper end of the protruded shaft 14*a* thereof, a coiled spring 18 of shape memory alloy such as nickel-titanium alloy interposed between the upper surface of the valve element 14 and the lower surface of the upper part of the valve body 16 for always urging closed the valve element 14, i.e., to move valve element 14 downwardly, and a bias spring 19 mounted between the collar 14*b* at the upper end of the protruded shaft 14*a* of the valve element 14 and the lower surface of the upper part of the valve body 16 for always urging the valve element 14 open, i.e., to move the valve element 14 upwardly. In the exemplary embodiment shown in FIGS. 2 and 3, the valve housing 12 is composed of a main cylindrical body 12' connected to the steam feed pipe 11 and a sub-cylindrical body 12'' engaged underneath the main cylindrical body 12′ and formed with an exhaust port 13. Reference numeral 20 designates a valve seat formed on the upper end of the sub-cylindrical body 12″ of the valve housing 12 so that the valve element can be seated thereon at the lower end.

The tensions of the springs 18 and 19 are so set that, when the interior of the valve housing 12 is maintained at a predetermined high temperature during the passing of steam, the tension of the spring 18 can elongate to overcome the tension of the bias spring 19, while when the interior of the housing 12 is lowered to a predetermined low temperature due to the concentration of condensed water of the steam, the spring 18 is contracted so as to allow, reversely, the tension of the spring 19 to overcome that of the spring 18 to be elongated.

The shape memory effect of the nickel-titanium shape memory alloy is produced by martensite transformation, and depends upon the temperature for recovering the operating temperature and hence the shape of the alloy. More specifically, the martensite transformation of the nickel-titanium alloy largely changes according to a small amount of the alloy composition and also varies according to the temperature for treating the shape memory. Therefore, the hysteresis of the transformation temperature at cooling and heating times is peculiar for the alloy. Thus, since the characteristic of the shape memory alloy cannot be varied, the hysteresis is reduced by utilizing the tension of the bias spring 19. More particularly, both the spring 18 of shape memory alloy and the bias spring 19 are simultaneously employed to construct a reversibly repeating mechanism having bidirectional operation.

In the freeze preventing valve of the invention thus constructed, the steam in the steam feed pipe 11 is partly cooled and condensed to produce condensed water, and when the condensed water flows into the hollow valve housing 12 to lower the temperature in the housing 12, the spring 18 of nickel-titanium shape memory alloy contracts so that the tension of the bias spring 19 overcomes that of the spring 18. Thus, as shown in FIG. 3, the valve element 14 moves upwardly in the cylindrical guide 15 of the valve body 16 by the supporting and guiding actions of the guide 15 to automatically open the exhaust port 13, thereby naturally exhausting externally the condensed water through the holes 16*a* in the perforated wall of the valve body 16 from the exhaust port 13.

When the interior of the valve housing 12 is again heated to a predetermined high temperature with the steam after the condensed water is completely exhausted in this manner, the spring 18 of shape memory alloy stretches to overcome the tension of the bias spring 19. Thus, the valve element 14 is again moved downwardly, as shown in FIG. 2, in the cylindrical guide 15 by the supporting and guiding actions of the guide 15, thereby automatically close the exhaust port 13.

According to the present invention as described above, since the freeze preventing valve comprises a valve body 16 longitudinally provided with a cylindrical guide 15 at the upper part thereof in a valve housing 12 connected to a steam feed pipe 11, a valve element 14 having a shaft disposed through the guide 15 of the valve body 16 to be able to open an exhaust port 13 opened at the lower end of the housing 12 to be elevationally guided in the guide 15 of the housing 12, a spring 18 of shape memory alloy interposed between the lower surface of the valve body 16 and the valve element 14 for urging the valve element 14 to close the valve element 14, a bias spring 19 mounted between the upper surface of the valve body 16 and the shaft 14*a* protruding from the guide 15 of the valve element 14 upwardly for urging the valve element 14 to open the valve element 14, said valve body 16 being formed with a plurality of holes 16*a* to be closed by the exhaust port 13 by the valve element 14 when steal is introduced from the pipe 11 through the housing 12 into the valve element to heat and elongate the spring 18 of shape memory alloy and to be released from the closure by the exhaust port 13 by the valve element 14 when the condensed water from the pipe 11 is introduced through the housing 12 into the valve body 16 to contract the spring 18 of shape memory alloy by the tension of the bias spring 19, the valve element of the freeze preventing valve is effectively supported and guided in the housing 12 via the guide 15 of the valve body 16. Since the both springs 18 and 19 are effectively mounted through the valve body 16, the exhaust port 13 can be automatically opened and closed with the spring 18 of shape memory alloy and the bias spring 19 instead of the conventional bellows. This particularly improves the operation of the freeze preventing valve in winter, thereby completely eliminating gas leakage from the conventional bellows, and preventing the valve from being lost in elongating function to elevationally move the valve element. Moreover, the necessity of providing a preliminary valve installed in the conventional valve to prevent the valve from being frozen can be obviated. Consequently, periodic inspection and maintenance for frozen valves and replacement of defective bellows are eliminated due to the use of the springs of shape memory alloy and bias springs, thereby providing the possibility of semipermanently using the freeze preventing valve and the reduction in the cost of the valve.

What is claimed is:

1. A freeze preventing valve comprising:

a valve cage body longitudinally provided with a cylindrical guide at the upper part thereof in a hollow valve housing connected to a steam feed pipe, a valve element having a shaft disposed through the guide of said valve body to be able to open an exhaust port opened at the lower end of the housing and to be elevationally guided within the guide of the housing, a spring of shape memory alloy interposed within the valve cage body between an upper interior surface of said valve body and said valve element for urging said valve element downwardly to close said valve element, a bias spring mounted between an upper exterior surface of said valve body and an upper end of the shaft protruding through the guide of said valve element for urging said valve element upwardly to open said valve element, said valve body being formed with a plurality of holes the exhaust port being closed by said valve element when steam is introduced from the pipe through the hollow valve housing into said valve cage body to heat and elongate said spring of shape memory alloy and to contact said bias spring, and the exhaust port being open by said valve element when the condensed water from the pipe is introduced through the housing into said valve body to contract said spring of shape memory alloy and elongate said bias spring by the tension of said bias spring.

2. The freeze preventing valve according to claim 1, wherein the lower part of said valve body is secured by threading to the hollow valve housing, and said bias spring is interposed between the upper surface of the valve body and a collar secured to the upper end of the protruded shaft of said valve element.

3. The freeze preventing valve according to claim 1, wherein said hollow valve housing comprises a main cylindrical body connected to the steam feed pipe, and a sub-cylindrical body engaged with said main cylindrical valve and formed with an exhaust port.

4. A freeze-proof valve adapted to be connected to a pipe carrying steam, said valve comprising:

a valve cage body adapted to be disposed vertically within a valve housing;

a valve element including a valve shaft and valve head attached to the lower end of said valve shaft, said valve head and a lower portion of said valve shaft being disposed within said valve cage body, and an upper part of said shaft passing upwardly out of said valve cage body through a guide element disposed in the upper part of said valve cage body, said valve head being selectively received in an exhaust port at the lower part of said valve housing, for opening said exhaust port to place said valve element in an open state, and for closing said exhaust port to place said valve element in a closed state in which substantially no fluid flows through said valve;

a shape memory alloy spring enclosed in said valve cage body and in force-transmitting relationship with an upper surface of said valve head and a lower surface of the upper part of said valve cage body for urging said valve element downward into said closed state when the temperature of fluid in contact with said shape memory alloy spring causes the temperature of said shape memory alloy spring to be greater than a predetermined temperature; and a bias spring in force-transmitting relationship with an upper end of the upper port of said valve shaft and an upper surface of the upper part of said valve cage body for urging said valve element upward into said open state when the temperature of fluid in contact with said shape memory alloy spring causes the temperature of said shape memory alloy spring to be less than said predetermined temperature.

* * * * *